US008888088B2

(12) United States Patent
Kimata

(10) Patent No.: US 8,888,088 B2
(45) Date of Patent: Nov. 18, 2014

(54) STAPLER ROTATION DEVICE FOR SHEET PROCESSING APPARATUS

(71) Applicant: Masanobu Kimata, Aichi (JP)

(72) Inventor: Masanobu Kimata, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/800,198

(22) Filed: Mar. 13, 2013

(65) Prior Publication Data

US 2013/0270761 A1 Oct. 17, 2013

(30) Foreign Application Priority Data

Mar. 13, 2012 (JP) ..... 2012-055978
Nov. 26, 2012 (JP) ..... 2012-257470

(51) Int. Cl.

| | |
|---|---|
| ***B65H 37/04*** | (2006.01) |
| ***B42B 4/00*** | (2006.01) |
| ***B42C 1/12*** | (2006.01) |
| ***B41L 43/12*** | (2006.01) |
| ***B41F 13/66*** | (2006.01) |

(52) U.S. Cl.

CPC . *B41L 43/12* (2013.01); *B42B 4/00* (2013.01); *B42C 1/12* (2013.01); *B41F 13/66* (2013.01)

USPC ..... 270/58.08; 399/410

(58) Field of Classification Search

CPC ..... B65H 37/04

USPC ..... 270/58.08; 399/410; 227/111

See application file for complete search history.

(56) References Cited

U.S. PATENT DOCUMENTS

| | | | | |
|---|---|---|---|---|
| 6,164,511 | A * | 12/2000 | Chung et al. | 227/148 |
| 6,343,785 | B1 * | 2/2002 | Yamada et al. | 270/58.08 |
| 6,402,006 | B1 * | 6/2002 | Nunes et al. | 227/110 |
| 7,681,873 | B2 * | 3/2010 | Tsutsui et al. | 270/58.08 |
| 8,474,808 | B2 * | 7/2013 | Matsuo | 270/58.08 |
| 2005/0189706 | A1 | 9/2005 | Tamura et al. | |
| 2005/0248083 | A1 | 11/2005 | Tsutsui | |
| 2006/0279037 | A1 * | 12/2006 | Kushida et al. | 270/58.08 |
| 2007/0057441 | A1 * | 3/2007 | Tsutsui et al. | 271/207 |
| 2007/0138730 | A1 * | 6/2007 | Tsutsui et al. | 270/58.09 |
| 2012/0207565 | A1 * | 8/2012 | Yamamoto | 412/6 |

FOREIGN PATENT DOCUMENTS

| | | |
|---|---|---|
| JP | 11-180628 | 7/1999 |
| JP | 2007-153552 | 6/2007 |
| JP | 2007-153605 | 6/2007 |
| JP | 2008-207918 | 9/2008 |

* cited by examiner

*Primary Examiner* — Patrick Mackey

(74) *Attorney, Agent, or Firm* — Harness, Dickey & Pierce, P.L.C.

(57) ABSTRACT

A sheet processing apparatus includes: a stapling unit that staples a sheet member; a moving unit that linearly moves the stapling unit; a rotating unit that rotates the stapling unit by abutment of an abutting member against an abutted member when the stapling unit is moved; a holding unit that holds the stapling unit rotated; and a restricting member that restricts rotation of the stapling unit by abutting against the abutting member.

11 Claims, 17 Drawing Sheets

STAPLER ROTATION DEVICE FOR SHEET PROCESSING APPARATUS

CROSS-REFERENCE TO RELATED APPLICATIONS

The present application claims priority to and incorporates by reference the entire contents of Japanese Patent Application No. 2012-055978 filed in Japan on Mar. 13, 2012 and Japanese Patent Application No. 2012-257470 filed in Japan on Nov. 26, 2012.

BACKGROUND OF THE INVENTION

1. Field of the Invention

The present invention relates generally to sheet processing apparatuses and image forming systems and, more particularly, to a sheet processing apparatus that performs predetermined processing, such as aligning and stapling, on a sheet member (e.g., sheet-like recording media in general, including recording sheets, transfer paper, and an OHP sheet) conveyed therein, and an image forming system including the sheet processing apparatus and an image forming apparatus.

2. Description of the Related Art

Known techniques of this sort are disclosed in Japanese Patent Application Laid-open No. 2007-153552, Japanese Patent Application Laid-open No. 2007-153605, and Japanese Patent Application Laid-open No. H11-180628. Of these, Japanese Patent Application Laid-open No. 2007-153552 discloses a sheet processing apparatus that includes, with the aim of offering a simple structure having one drive source and a wider range of choice of stapling positions, a stapling unit that staples sheet members conveyed therein, a unit that moves the stapling unit in a direction orthogonal to a sheet member conveying direction, and a single drive source that drives the unit for moving the stapling unit. The sheet processing apparatus disclosed in Japanese Patent Application Laid-open No. 2007-153552 further includes another unit that, during the process in which the moving unit moves the stapling unit, causes part of the stapling unit to abut against a protrusion formed at a predetermined position to thereby rotate the stapling unit.

Japanese Patent Application Laid-open No. 2007-153605 discloses a sheet processing apparatus that aims at achieving reduction in the size of the apparatus and space-saving, and guaranteeing high stapling quality. The sheet processing apparatus includes a first support member that abuts against an end portion of the sheet member upstream in a sheet member conveying direction during aligning of a sheet member, a second support member that supports other portions of the sheet member, and a sheet stapling unit that staples the sheet member. In the sheet processing apparatus disclosed in Japanese Patent Application Laid-open No. 2007-153605, the sheet stapling unit has a stapling direction that extends in parallel with a surface of the first support member in abutment with the end portion of the sheet member. The sheet processing apparatus further includes a rotating unit that moves the sheet stapling unit in a direction orthogonal to the sheet member conveying direction using a single drive source to thereby rotate the sheet stapling unit through a predetermined range. During the process in which the rotating unit moves the sheet stapling unit, the sheet stapling unit is rotated with part thereof made to abut against a protrusion formed at a predetermined position.

Japanese Patent Application Laid-open No. H11-180628 discloses a sheet post-processing apparatus that, with the aim of facilitating and expediting assembly adjustment and service procedures by simply constructing stapling process components of the sheet post-processing apparatus, performs a stapling process for sheets on which images have been formed conveyed from an image forming apparatus before discharging the sheets into a discharge tray using a discharging unit. The sheet post-processing apparatus disclosed in Japanese Patent Application Laid-open No. H11-180628 further includes a pair of staplers that perform a stapling process for the sheets of various sizes on which images have been formed, the staplers being configured to be driven for translation and rotation by a single drive source. For sheets of various small sizes, the staplers are translated for a stapling process in a width direction orthogonal to a sheet conveying direction and, for sheets of various large sizes, the staplers are translated and rotated for a stapling process. In addition, each of the staplers is rotated by a cam plate fixed to a sheet post-processing apparatus main unit and a cam follower fixedly mounted on the stapler.

The technique disclosed in Japanese Patent Application Laid-open No. 2007-153552 holds a stapler at an angular position for oblique stapling through hooking onto a claw. Hooking a heavy stapler onto the claw as described above poses a problem in that repeated hooking and unhooking operations cause sag, or in the worst case, break the claw. The technique also poses a problem in that the claw is unable to hold the weight of the stapler, if an aligning (stapler tray) angle is acute.

The technique disclosed in Japanese Patent Application Laid-open No. 2007-153605 holds a stapler at an angular position for oblique stapling with a spring. To hold the stapler at an angular position only with a spring, the spring needs to offer a high load capacity to sustain the weight of the stapler. This increases motor load required for changing posture through abutment, resulting in a problem of an additional need to increase motor current. If the aligning angle is acute, the spring load needs to be further increased, which increases motor load with a resultant further increase in current.

The technique disclosed in Japanese Patent Application Laid-open No. H11-180628 holds the stapler at an angular position for oblique stapling with a guide rail. The guide rail limits a range over which oblique stapling can be performed, defying stapling at a central position. This poses a problem of not being able to respond to users' needs.

There is therefore a need to enable reliable oblique stapling without involving increased motor current, enable stapling at a wide range from the center to end portions and enable oblique stapling of various sheet sizes.

SUMMARY OF THE INVENTION

It is an object of the present invention to at least partially solve the problems in the conventional technology.

A sheet processing apparatus includes: a stapling unit that staples a sheet member; a moving unit that linearly moves the stapling unit; a rotating unit that rotates the stapling unit by abutment of an abutting member against an abutted member when the stapling unit is moved; a holding unit that holds the stapling unit rotated; and a restricting member that restricts rotation of the stapling unit by abutting against the abutting member.

A sheet processing apparatus includes: a stapling unit that staples a sheet member; a moving unit on which the stapling unit is mounted via a rotatable first rotating member; a driving unit that linearly moves the moving unit; a rotatable second rotating member that is disposed in the moving unit, changes an orientation of the stapling unit in cooperation with the first rotating member, and includes an abutting member; a holding unit that holds the orientation of the stapling unit at a plurality of positions; an abutted member that changes the orientation of the stapling unit held by the holding unit via the second rotating member; and a restricting member disposed in parallel with a direction in which the stapling unit moves, the restricting member restricting the orientation of the stapling unit held by the holding unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An arrangement according to one aspect of the present invention includes a plate-like restricting member disposed in a direction in parallel with a direction in which a stapler moves toward a position at which oblique stapling is performed. The restricting member functions to restrict an orientation of the stapler. The restricting member includes a plurality of restricting members disposed along the stapler moving direction. The stapler abuts against an abutted member and to be thereby rotated. This arrangement has a gap between the restricting member and the abutted member so that the stapler can smoothly move to a rear side or a front side of the restricting member after having been rotated upon abutment with the abutted member. An embodiment of the present invention will be described below with reference to the accompanying drawings.

Figure 1:
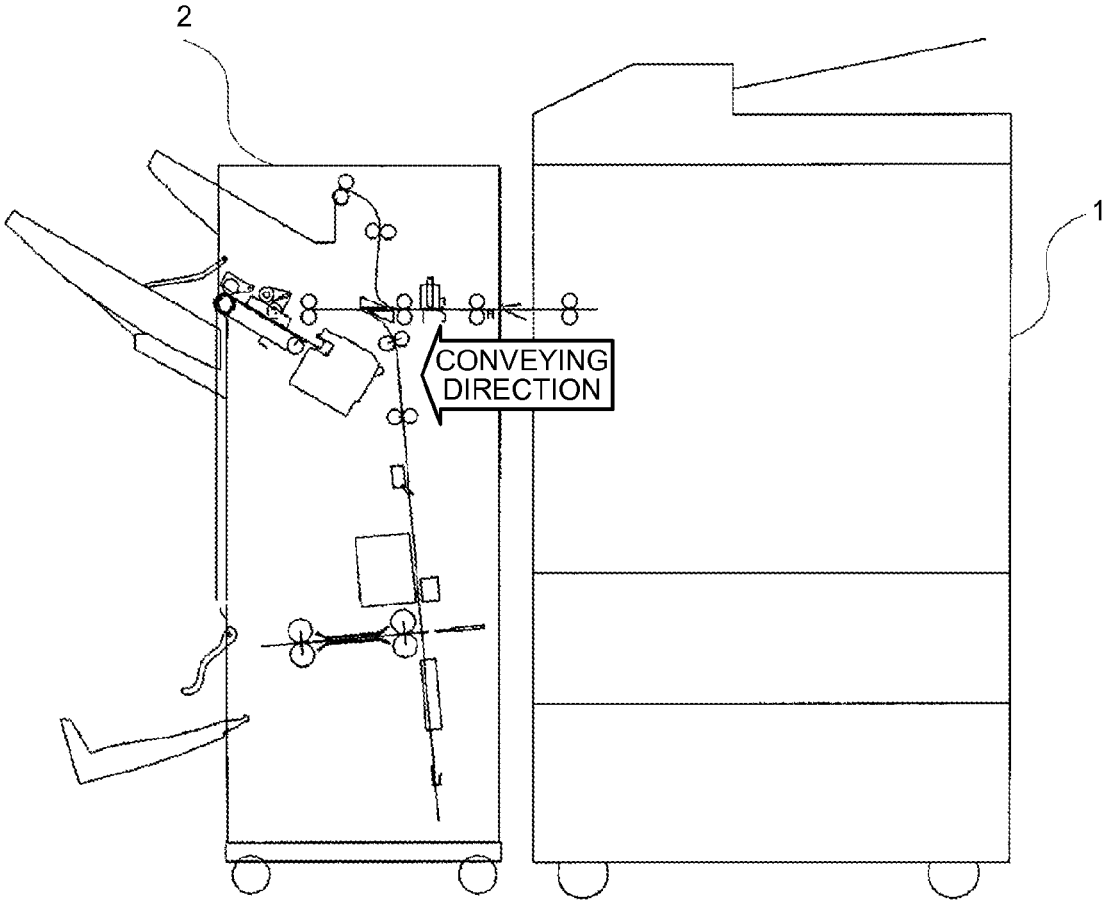
FIG. 1 is a diagram illustrating a system configuration of an image forming system according to an embodiment of the present invention.

FIG. 1 is a diagram illustrating a system configuration of an image forming system according to the embodiment of the present invention. The image forming system includes an image forming apparatus 1 and a sheet post-processing apparatus 2 as a sheet processing apparatus. The sheet post-processing apparatus 2 is mounted on a side surface of a main unit of the image forming apparatus 1. The sheet post-processing apparatus 2 performs predetermined processing on a sheet member on which an image has been formed, discharged from a discharging port at the side surface of the main unit of the image forming apparatus 1.

Figure 2:
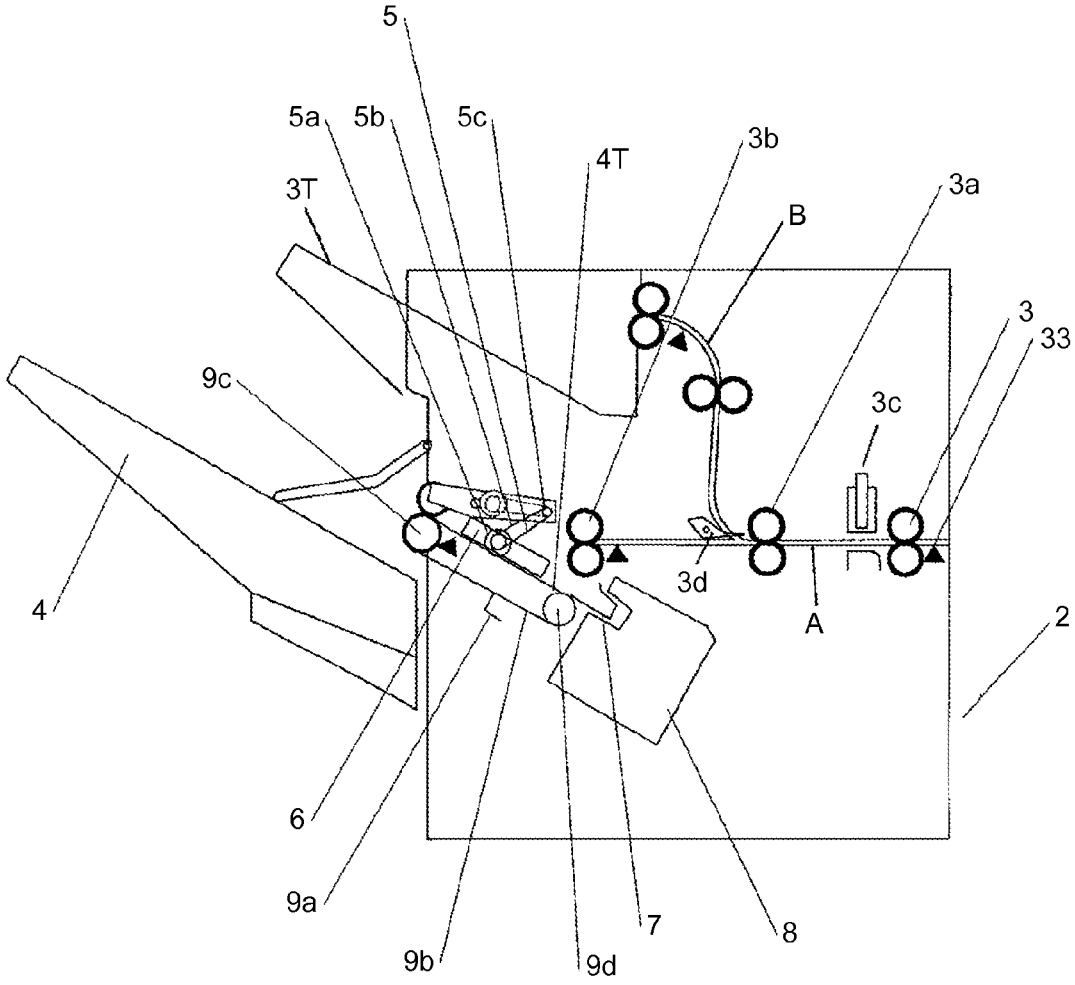
FIG. 2 is a diagram illustrating details of an upper portion of a sheet post-processing apparatus.

FIG. 2 is a diagram illustrating details of an upper portion of the sheet post-processing apparatus 2. Referring to FIG. 2, the sheet post-processing apparatus 2 includes entrance rollers 3, a discharge tray 4, a staple tray 4T, a return roller 5, a jogger 6, a reference fence 7, a stapler 8, and an ejecting claw 9*a*. The sheet post-processing apparatus 2 further includes a punch unit 3*c* and pairs of 1st and 2nd carriage rollers 3*a*, 3*b* disposed in a horizontal conveying path A that extends from the entrance roller 3 to the staple tray 4T. In addition, an upper discharge conveying path B is bifurcated from a bifurcation along the horizontal conveying path A immediately after the pair of 1st carriage rollers 3*a* downstream in a sheet conveying direction, so that a sheet can be discharged onto an upper discharge tray 3T. The bifurcation at which the upper discharge conveying path B is bifurcated from the horizontal conveying path A has a bifurcating claw 3*d* disposed thereat. The bifurcating claw 3*d* is operated to change its position, so that the sheet is discharged onto either the discharge tray 4 or the upper discharge tray 3T. If the sheet is to be discharged onto the discharge tray 4, the sheet may be discharged directly onto the discharge tray 4 or temporarily discharged onto the staple tray 4T to thereby be subject to stapling before being discharged onto the discharge tray 4.

The return roller 5 is disposed to face a sheet member placement surface of the staple tray 4T. The return roller 5 includes a roll 5*a* that conveys a sheet member and an arm 5*b* that supports the roll 5*a* and is rotatably supported by a pivot 5*c*. The jogger 6 includes a vertical portion that acts on an end face of the sheet member and a stacking portion on which the sheet member is stacked. In addition, the jogger 6 is formed in pairs to include a front jogger that aligns a front side of the sheet member and a rear jogger that aligns a rear side of the sheet member. The reference fence 7 aligns an end portion (rear end portion) of the sheet member in a sheet member discharging direction. The sheet member discharged onto the staple tray 4T or the jogger 6 is conveyed by the return roller 5 in a direction opposite to the discharging direction, so that a rear end portion of the sheet member is abutted against the reference fence 7, which constitutes an aligning operation.

The stapler 8 is disposed near the reference fence 7 and performs a stapling operation on a position in the sheet member aligned by the reference fence 7 near the rear end portion of the sheet member. The ejecting claw 9*a* is disposed so as to rise from an ejecting belt 9*b*. The ejecting belt 9*b* is an endless belt regulated across a drive pulley 9*c* and a driven pulley 9*d*. The ejecting claw 9*a* is disposed at a central portion in a width direction of the ejecting belt 9*b*. A bundle of sheet members advanced by the reference fence 7 up to a position at which the ejecting claw 9*a* can engage is pushed and ejected out onto the discharge tray 4 by the ejecting claw 9*a* as the ejecting belt 9*b* is driven.

An entrance sensor 33 disposed before the entrance rollers 3 detects that the sheet member discharged from the image forming apparatus 1 is conveyed into the sheet post-processing apparatus 2. Driving of the entrance rollers 3 is started with this detection signal used as a trigger. It is noted that the driving of the entrance rollers 3 may be started by a signal indicative of a sheet member being conveyed from the main unit of the image forming apparatus 1. The entrance sensor 33 is also used for jam detection when a sheet is stuck. The sheet member conveyed by the entrance rollers 3 is further conveyed by the pairs of 1st and 2nd carriage rollers 3*a*, 3*b* and thereafter discharged onto the discharge tray 4 or the staple tray 4T to be described later.

Figure 3:
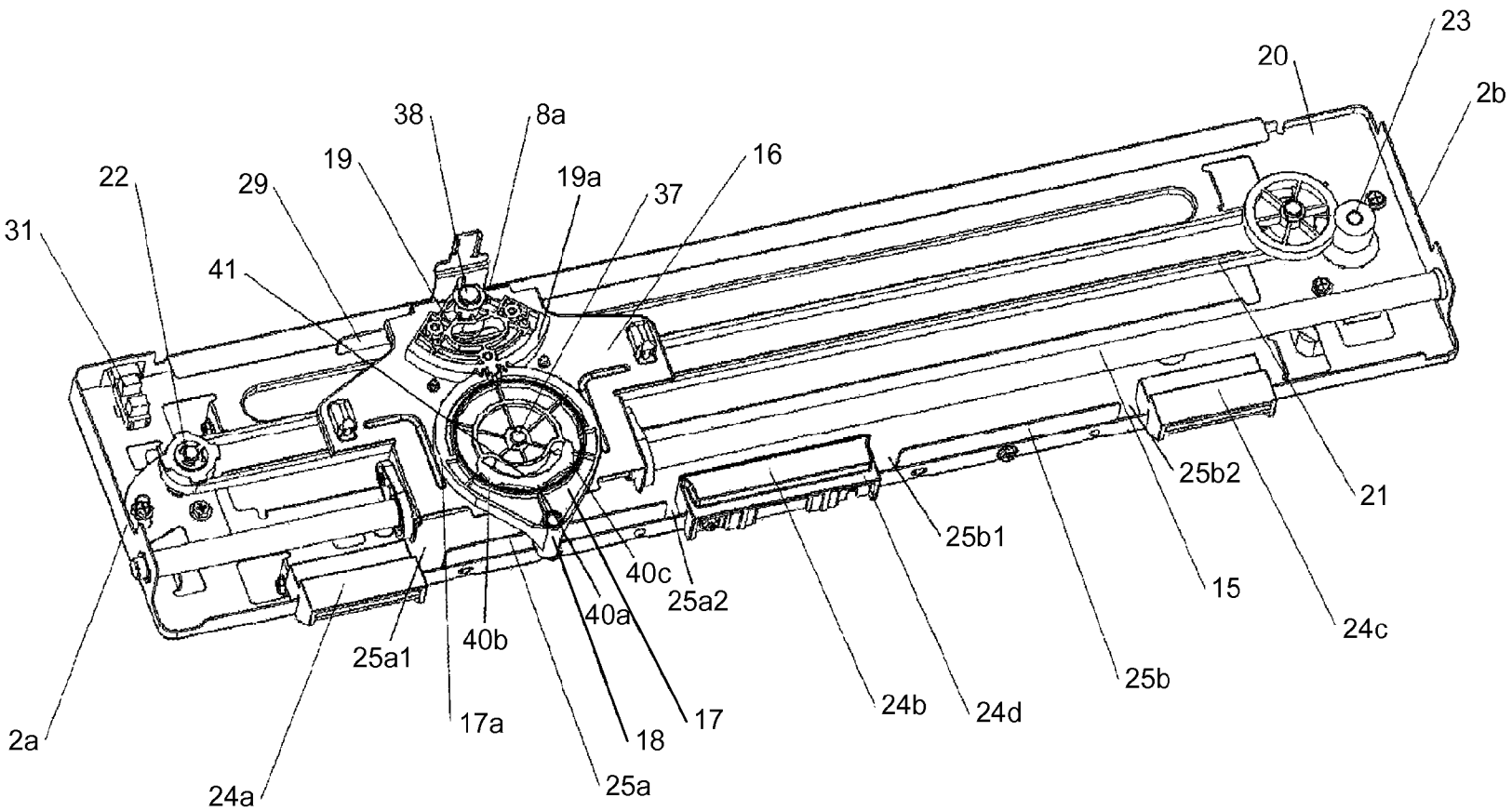
FIG. 3 is a perspective view illustrating a mounting condition and a moving mechanism of a stapler.

FIG. 3 is a perspective view illustrating a mounting condition and a moving mechanism of the stapler 8. The stapler 8 is omitted in FIG. 3 to simplify the drawing and clarify the moving mechanism.

A stapler unit according to the embodiment of the present invention is characterized by:

1) Low cost because of no dedicated drive unit for changing the direction of the stapler; and
2) Being capable of parallel stapling and oblique stapling regardless of sheet size because of an arrangement not rotating the stapler along a rail, though having no dedicated drive unit.

The two characteristics will be described in more detail below. Referring to FIG. 3, the stapler unit is supported by a frame 20. The frame 20 has a front mounting surface 2*a* and a rear mounting surface 2*b*. A guide shaft (guide bar) 15 is assembled to the front mounting surface 2*a* and the rear mounting surface 2*b* so as to extend therebetween in a direction perpendicular to the sheet member conveying direction. A slider (forward moving member) 16 that serves as a supporting base for stapler motion is slidably mounted on the guide shaft 15. The slider 16 includes a 1st shaft 37 and a 2nd shaft 38 mounted thereon, the 1st shaft 37 and the 2nd shaft 38 having axes facing vertically upwardly. A gear 17 and a sector gear 19 are rotatably mounted on outer peripheral portions of the 1st shaft 37 and the 2nd shaft 38, respectively. The stapler 8 is mounted on, and rotates integrally with, the sector gear 19. The sector gear 19 meshes with the gear 17 and the sector gear 19 and the gear 17 rotate cooperatively with each other in a range in which the sector gear 19 is in mesh with the gear 17.

The sector gear 19 is fixed to the stapler 8. The gear 17 includes an abutting portion 18 for changing the direction of the stapler 8. The abutting portion 18 is formed to have a size and to be disposed such that, when positioned as illustrated in FIG. 3, the abutting portion 18 has an inside positioned so as to protrude from a side surface of the frame 20. The stapler 8 is mounted rotatably on the slider 16 via the sector gear 19.

Figure 4A:
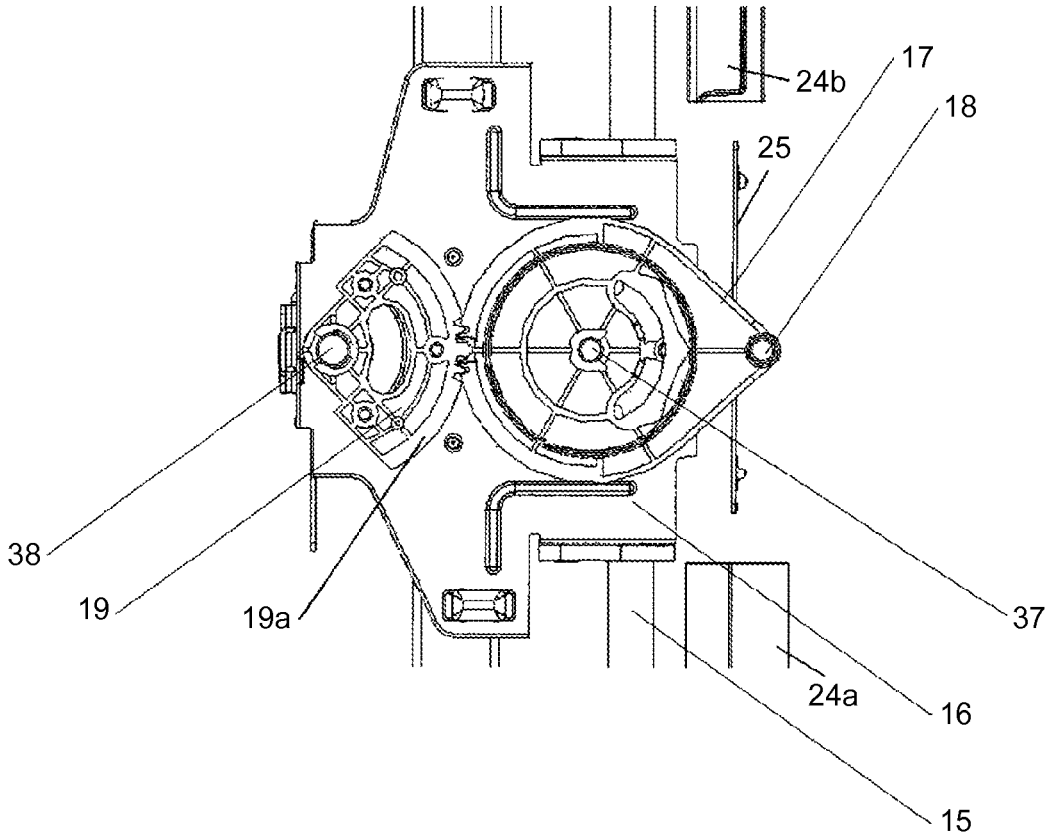
FIGS. 4A and 4B are diagrams illustrating a relationship among a slider, a sector gear, and a gear.
Figure 4B:
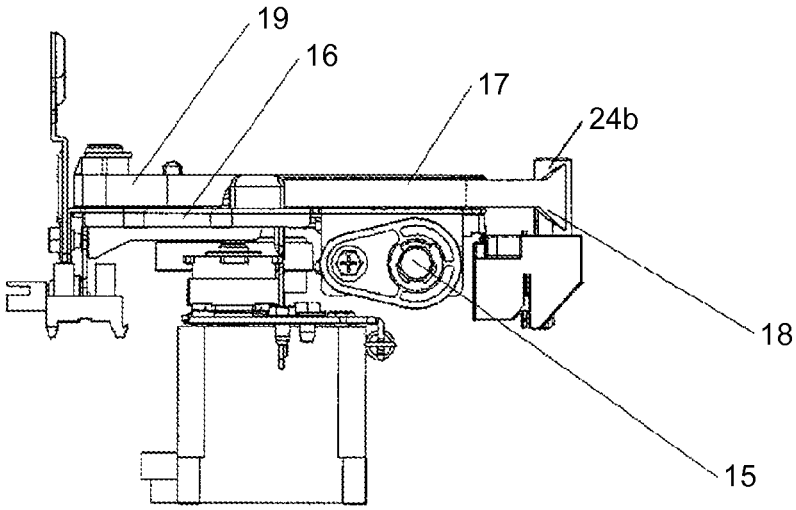

FIGS. 4A and 4B are diagrams illustrating a relationship among the slider 16, the sector gear 19, and the gear 17, FIG. 4A being a plan view and FIG. 4B being a front elevational view. Referring to FIGS. 3, 4A, and 4B, the gear (second rotating member) 17 integrates a gear portion 17*a* with the abutting portion 18. The gear 17 is capable of rotating forward and backward about the shaft 37 on the slider 16 in a condition of being in contact with, and on, a surface of the slider 16. It is noted that, for example, a sliding member or grease that reduces contact resistance between the slider 16 and the gear 17 may be used therebetween.

Figure 6:
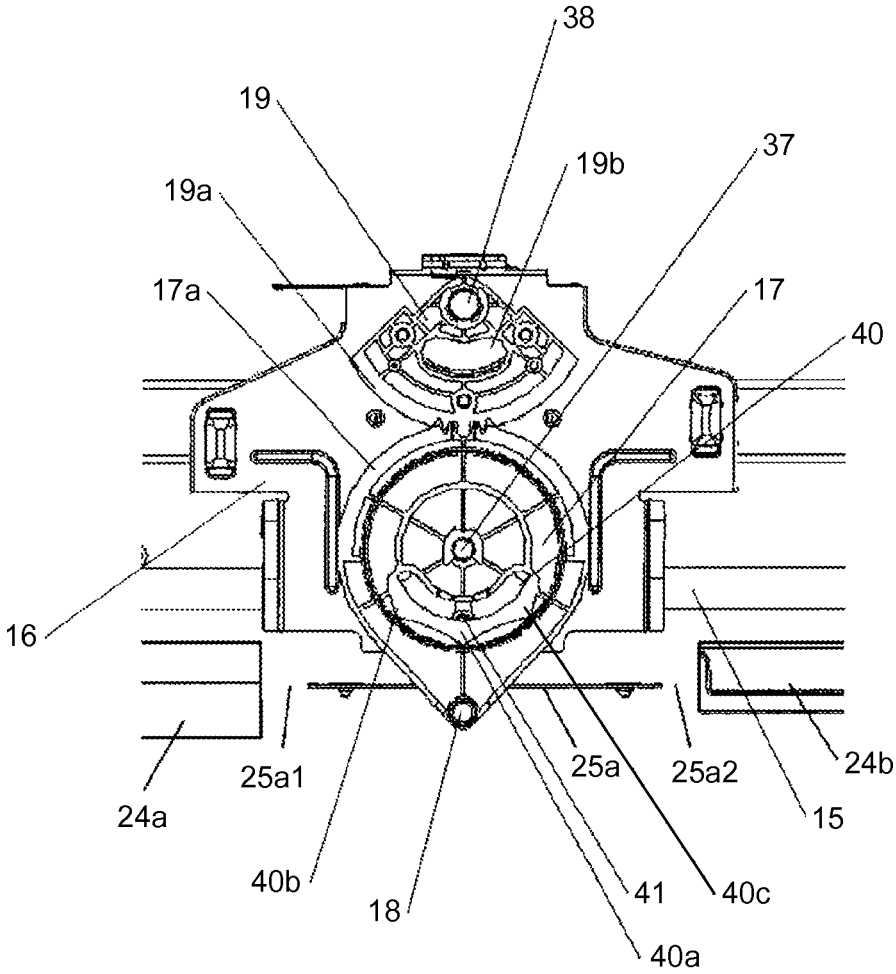
FIG. 6 is a plan view illustrating a condition of engagement between the sector gear and the gear and a relative positional relationship therebetween in a condition of parallel stapling.
Figure 7:
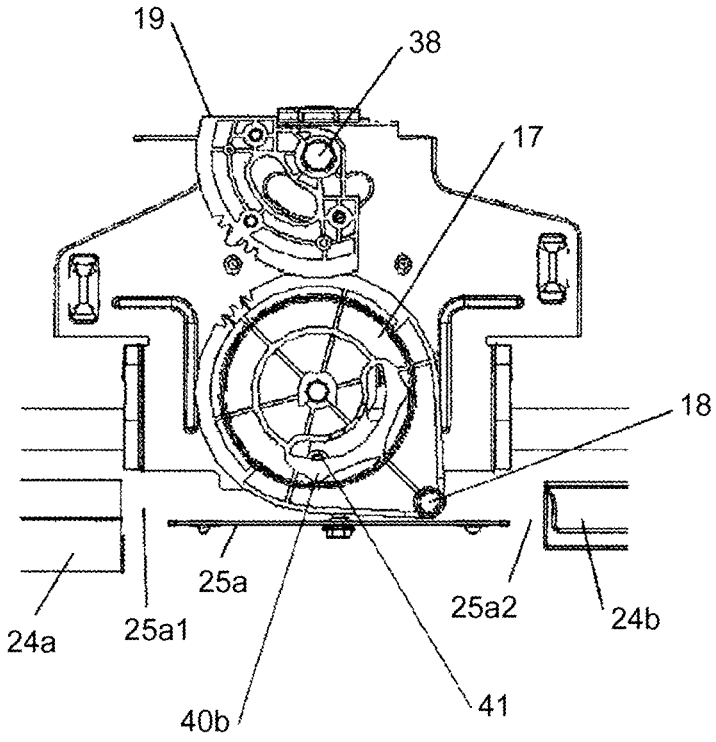
FIG. 7 is a plan view illustrating a condition of engagement between the sector gear and the gear and a relative positional relationship therebetween in a condition of oblique stapling.

To set an angle of the stapler 8 with the gear 17, the gear 17 has a hole (slot) 40 formed therein and includes a cylindrical or spherical holding member 41 disposed in the hole 40. Referring to FIGS. 6 and 7, the hole 40 has V-grooves 40*a*, 40*b*, 40*c* formed therein at three places. The holding member 41 is pressed by a spring not illustrated in directions of the V-grooves 40*a*, 40*b*, 40*c* at all times so as to be capable of being elastically fitted in, and released from, the hole 40. The hole 40 and the holding member 41 ensure that the stapler 8 is easily brought to a stop for parallel stapling (0°), rear oblique stapling) (45°), or front oblique stapling (−45°). The groove is not necessarily shaped into a V and may be shaped arcuately. The slider 16 has a plane and the gear 17 has a rotary plane, each extending in parallel with a stapling reference surface of the stapler 8. FIGS. 6 and 7 are plan views, each illustrating a condition of engagement between the sector gear 19 and the gear 17 and a relative positional relationship therebetween.

The abutting portion 18 that forms part of the gear 17 and is disposed at one place has an abutting part formed into a curved surface so as to make rotation smooth upon abutment against an abutted member 24. The sector gear (first rotating member) 19 is rotatable about the shaft 38 of the slider 16 and has a rotary plane extending in parallel with the stapling reference surface of the stapler 8 as with the gear 17. The sector gear 19 functions similarly by having a hole at the position of the shaft 38 and inserting a cylindrical shaft formed integrally with, and to protrude from, the sector gear 19 into the hole. The sector gear 19 has a gear portion 19*a* in mesh with the gear portion 17*a* of the gear 17, so that rotation of the sector gear 19 transmits a rotational drive force to the gear 17, thereby rotating the gear 17. The 2nd shaft 38 is positioned with a predetermined positional relationship with a staple position (stapling position) of the stapler Thus, the staple position defines the position of the 2nd shaft 38.

Figure 5:
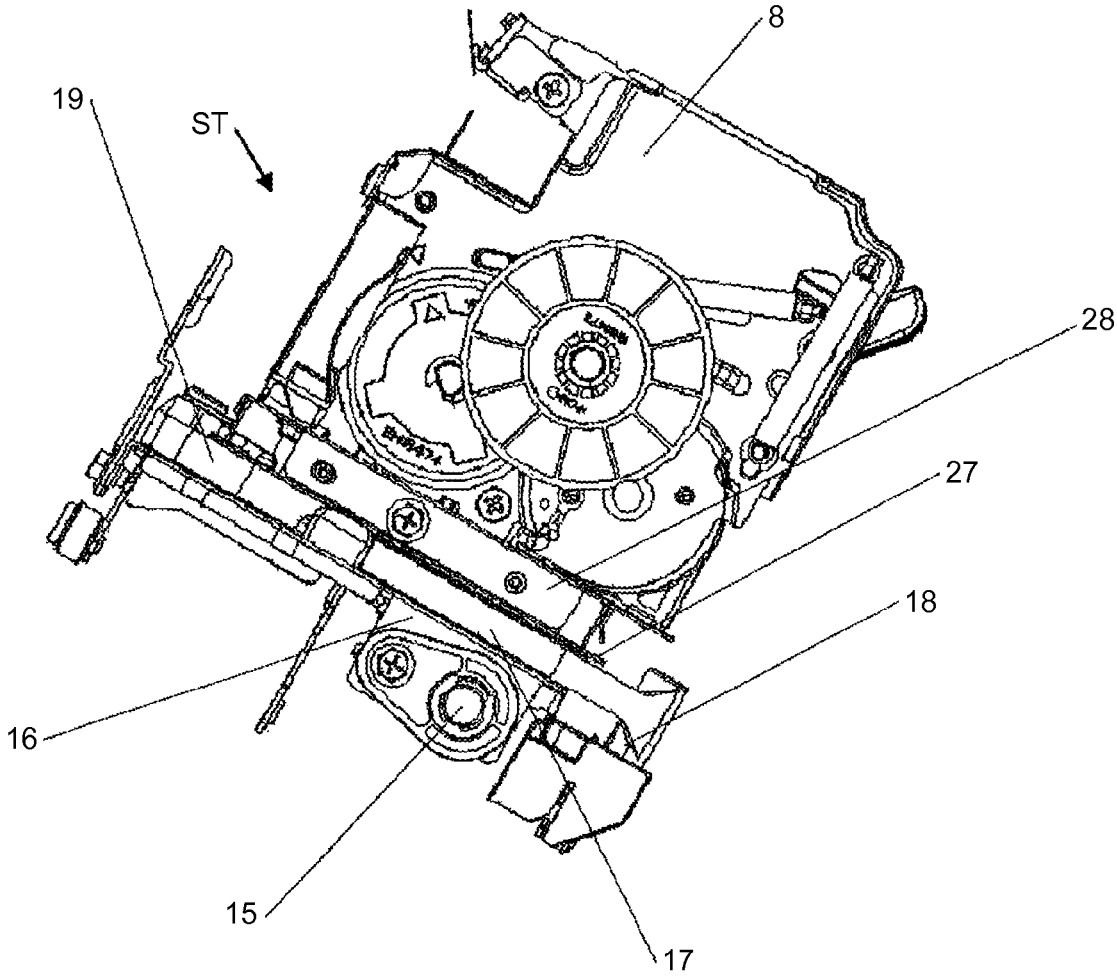
FIG. 5 is a diagram illustrating a condition in which the stapler is mounted on the sector gear.

FIG. 5 is a diagram illustrating a condition in which the stapler 18 is mounted on the sector gear 19. Referring to FIG. 5, a bracket 27 is fixed to the sector gear 19. The stapler unit that integrates the stapler 8 with a stapler bracket 28 fixed to the stapler 8 is mounted on the bracket 27.

Though the bracket 27 integrated with the sector gear 19 does not pose any structural problem, the bracket 27, which is subject to repeated removal from, and reinstallation to, the stapler bracket 28, is required to offer repeatability strength. In the embodiment of the present invention, it is advantageous in terms of cost to use resin for the gear portion 19*a* and metal for the bracket 27. To satisfy mechanical strength and cost, however, only resin or metal may be used to build an integrated unit. This similarly applies to the stapler bracket 28 and the stapler bracket 28 integrated with the stapler 8 does not pose any structural problem, either. Being required to offer strength, the stapler bracket 28 is formed of metal (with a plastic gear).

The stapler 8 is rotated integrally with the sector gear 19 about the 2nd shaft 38 on the slider 16 up to front and rear oblique stapling positions. The stapler 8 is not provided with any drive mechanism for rotation and is rotated through abutment of the abutting portion 18. The gear 17 and the sector gear 19 that are rotatable are thus disposed beneath the stapler 8. The stapler unit 8 fastened to the sector gear 19 is rotated through 45° each to the rear and to the front, a total of 90°. In the examples illustrated in FIGS. 6 and 7, the sector gear 19 meshes with, and is rotated by, the gear 17, which results in the angle of the stapler 8 being changed.

Referring back to FIG. 3, a timing belt 21 is trained over pulleys 22 of a motor (staple unit moving motor) 23 with pulleys and the slider 16 is fixed to the timing belt 21. The timing belt 21 is rotated through rotation of the motor 23 with pulleys and the rotational movement results in the slider 16 reciprocating along the guide shaft 15.

The abutting portion 18 abuts against the abutted member 24 to rotate the gear 17. The abutted member 24 is formed into a guide rail shape. As is known from FIG. 3, the abutted member 24 includes first to third protrusions 24*a*, 24*b*, 24*c* that are fixed, as with the guide shaft 15, between the front mounting surface 2*a* and the rear mounting surface 2*b* of the frame 20. When the abutted member 24 is used, the abutting portion 18 abuts against the 1st protrusion 24*a*, the 2nd protrusion 24*b*, or the 3rd protrusion 24*c* and, under this condition, the slider 16 is further moved to thereby rotate the gear 17. The gear 17 transmits the rotation by the abutting portion 18 to the sector gear 19 and the stapler 8 is integrally rotated relative to the rotation of the sector gear 19.

1st and 2nd plate-like members 25*a*, 25*b* as a characteristic part of the present invention are fixed between the front mounting surface 2*a* and the rear mounting surface 2*b* in a direction in parallel with the moving direction of the stapler 8. In addition, gaps are provided among the 1st and 2nd plate-like members 25*a*, 25*b* and the 1st to 3rd protrusions 24*a*, 24*b*, 24*c*: specifically, referring to FIG. 3, there is a 1st gap 25*a*1 between the 1st protrusion 24*a* and the 1st plate-like member 25*a*, a 2nd gap 25*a*2 between the 2nd protrusion 24*b* and the 1st plate-like member 25*a*, a 3rd gap 25*b*1 between the 2nd protrusion 24*b* and the 2nd plate-like member 25*b*, and a 4th gap 25*b*2 between the 3rd protrusion 24*c* and the 2nd plate-like member 25*b*. Each of the 1st to 4th gaps 25*a*1, 25*a*2, 25*b*1, 25*b*2 is so wide that the abutting portion 18 can pass therethrough.

Figure 8B:
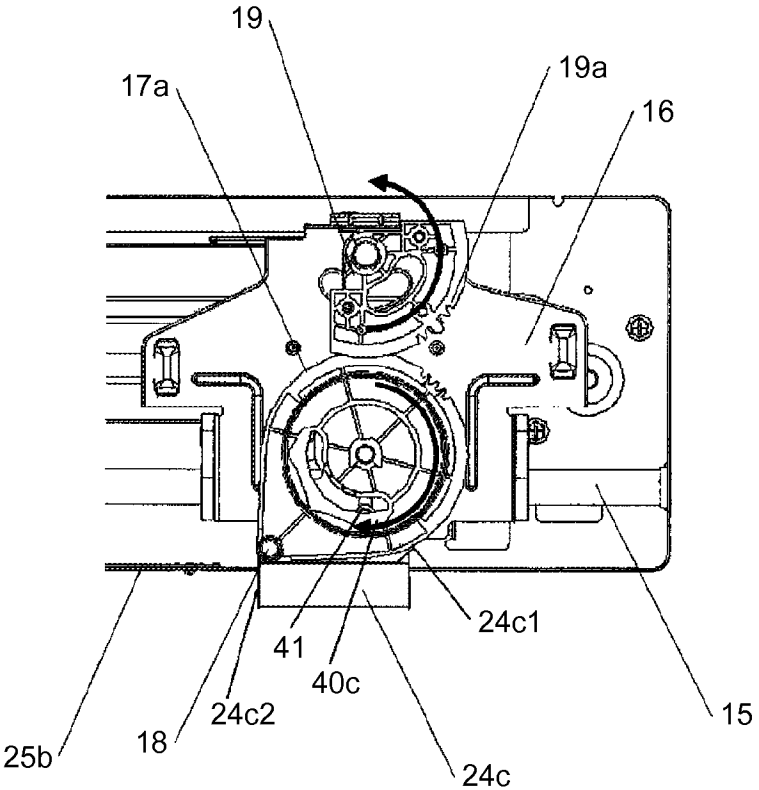
FIGS. 8A and 8B are diagrams illustrating a stapling operation when a sheet member is to be moved to one side.
Figure 8A:
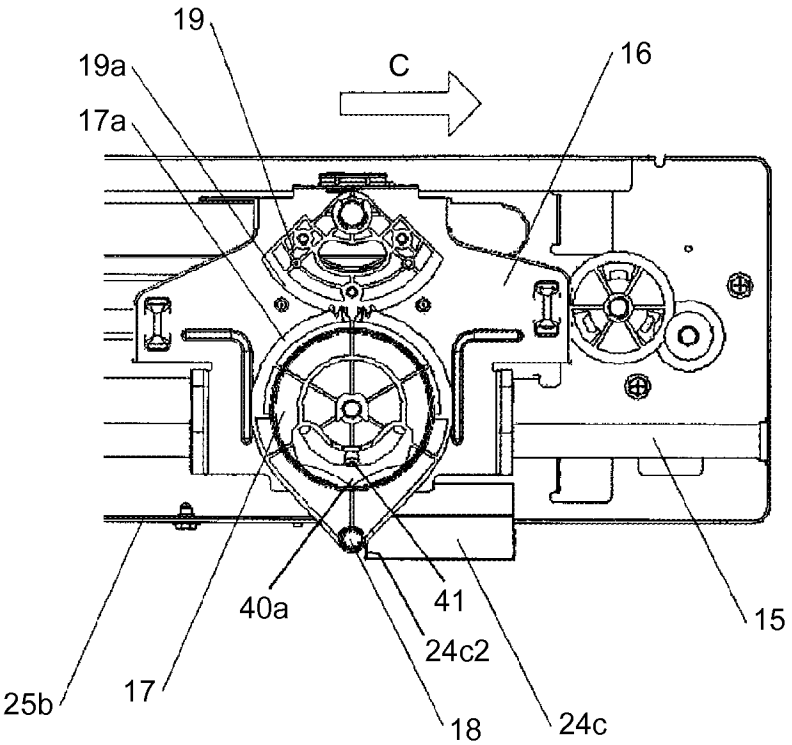

FIGS. 8A and 8B are diagrams illustrating a stapling operation when a sheet member is to be moved to one side. When a sheet member is to be moved to one side, the rear stapling position (and the front stapling position) does not depend on the sheet size. Referring to FIG. 8A, the slider 16 moves to the rear in the parallel stapling condition and the abutting portion 18 of the gear 17 abuts against a side wall 24*c*2 on the left side of the 3rd protrusion 24*c*. The slider 16 then further moves to the rear, which causes the gear 17 to rotate 45° clockwise as illustrated in FIG. 8B. The stapler 8 moves to the rear a distance corresponding to a predetermined number of pulses under this condition. The stapler 8 waits until a predetermined number of sheet members are stacked. When the predetermined number of sheet members are then stacked, the stapler 8 performs a stapling process and a stapled bundle of sheet members is discharged by the ejecting claw 9*a*. At this time, the abutting portion 18 is held in a position of being fitted in an inside 24*c*1 of the protrusion 24*c* even in oblique stapling, so that the stapler 8 is angled at 45° at all times.

For alignment with reference to the center, the stapler 8 moves a distance corresponding to a predetermined number of pulses in accordance with the sheet size+a predetermined number of pulses for each sheet, or moves in a direction of a home position (HP: front of the apparatus) a distance corresponding to a predetermined number of pulses. The stapler 8 then waits at that position until a predetermined number of sheets are stacked and, when the predetermined number of sheet members are stacked, the stapler 8 performs a stapling process before a discharge by the ejecting claw 9*a*.

Figure 9B:
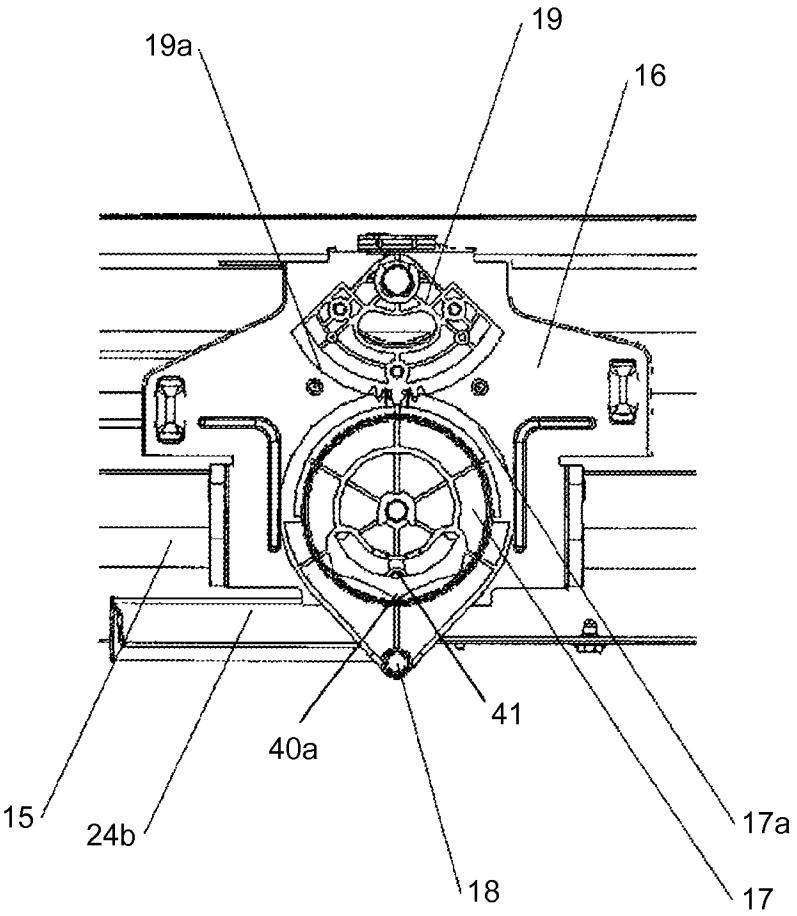
FIGS. 9A and 9B are diagrams illustrating a condition in which the stapler returns to a home position (HP) side from an oblique stapling position when the sheet size is small.
Figure 9A:
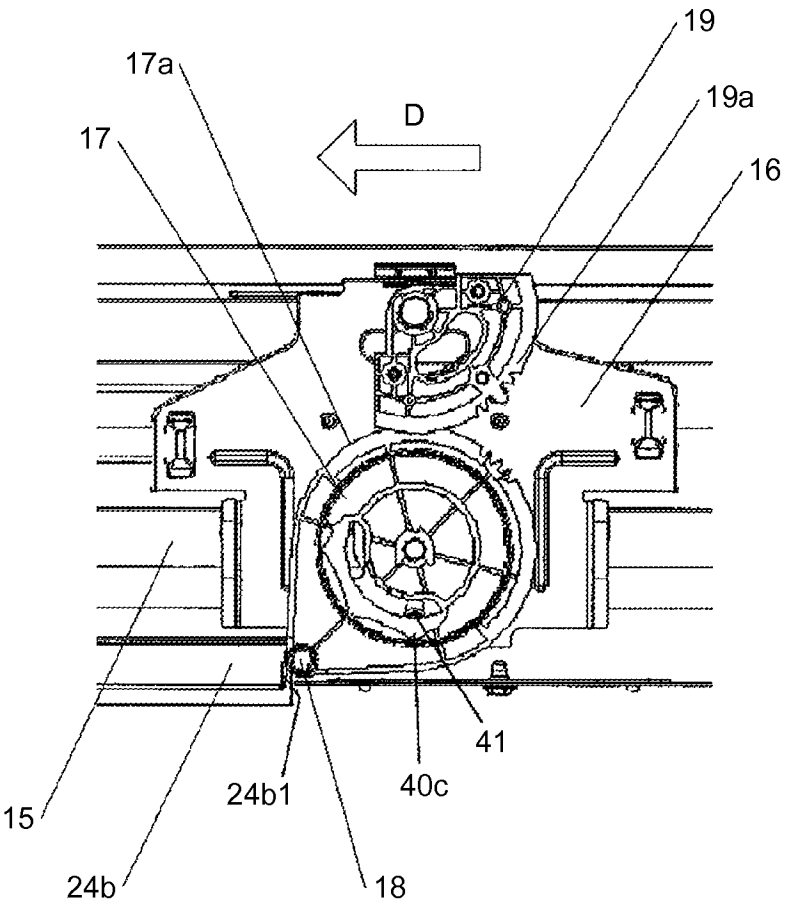
Figures 15A, 15B:
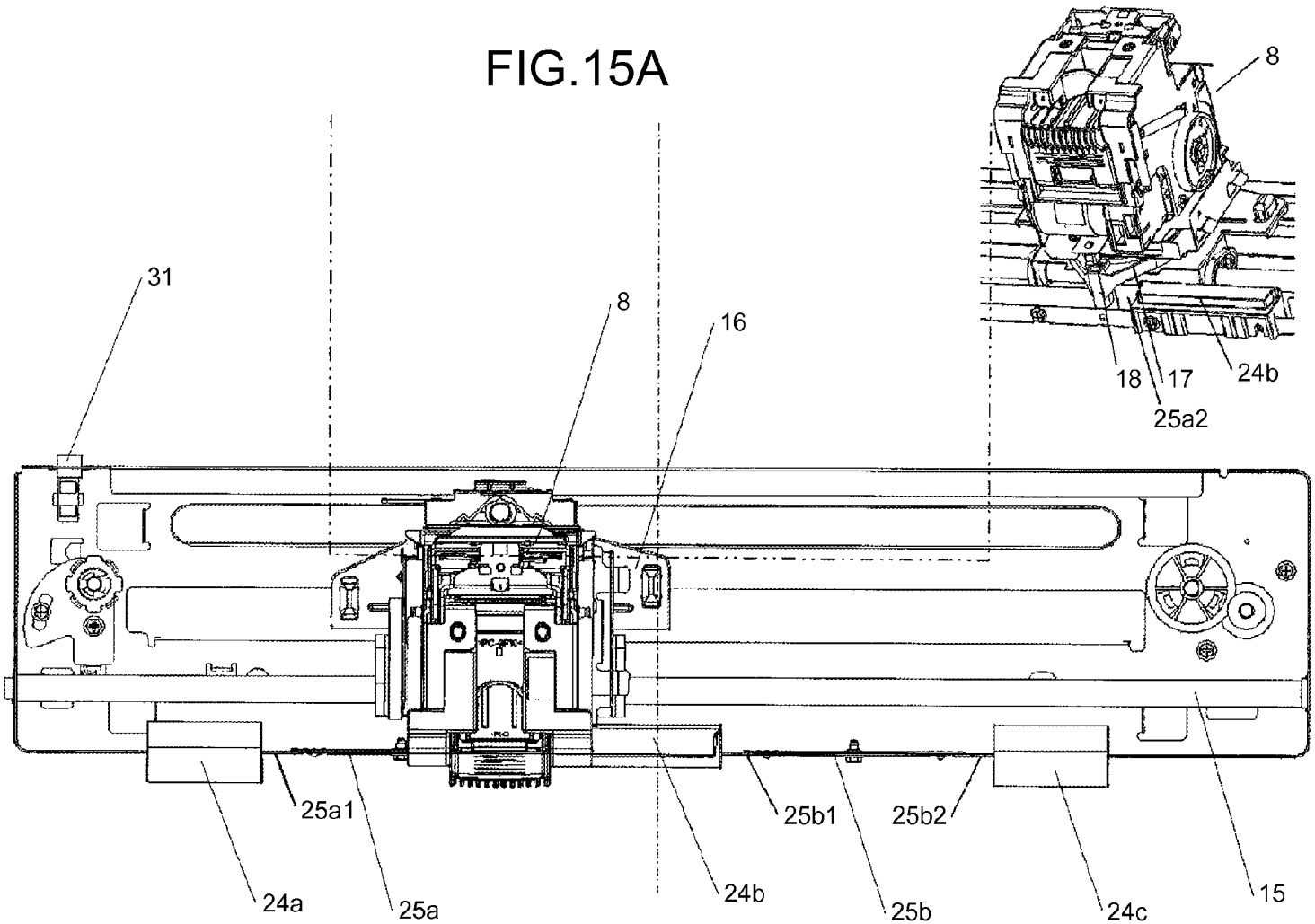
FIGS. 15A and 15B are diagrams illustrating movement from the parallel stapling condition illustrated in FIG. 9B to a position corresponding to a minimum stapling size of the sheet member.

Positions of the 1st to 3rd protrusions 24*a*, 24*b*, 24*c* of the abutted member 24 are set such that, when the stapler 8 returns from the position illustrated in FIG. 8B to the HP side to respond to a small sheet size, the abutting portion 18 does not abut against the 1st protrusion 24*a* of the abutted member 24 (the angle of the stapler is not changed) up to the minimum stapling size of the sheet member as illustrated in FIG. 15A after the abutting portion 18 has abutted against a side wall 24*b*1 on the right of the 2nd protrusion 24*b* as illustrated in FIG. 9A to thereby bring the stapler 8 into a parallel position. It is noted that FIG. 15A is a plan view and FIG. 15B is a perspective view illustrating the stapler 8 and parts around the same.

For rear parallel stapling, operation to be started with the stapler 8 at the HP is as follows. Specifically, when the slider 16 moves in a direction of an arrow D (leftward) in FIG. 9A upon receipt of a rear parallel stapling mode signal, the stapler on the slider 16 moves in a 45° angled position. Referring to FIG. 9B, when the abutting portion 18 of the gear 17 abuts against the side wall 24*b*1 on the right of the 2nd protrusion 24*b* of the abutted member 24, a leftward movement in FIG. 9B of the slider 16 causes the gear 17 to start rotating counterclockwise in FIG. 9B with the abutting portion 18 in abutment against the side wall 24*b*1 of the 2nd protrusion 24*b* (the slider is moving). The rotation of the gear 17 causes the sector gear 19 to rotate further, so that the stapler 8 integrated with the sector gear 19 rotates clockwise in FIG. 9B.

When the abutting portion 18 rotates to thereby leave the side wall 24*b*1 of the 2nd protrusion 24*b* (to be positioned outside the 2nd protrusion 24*b*), the gear 17 stops rotating, so that the stapler 8 is placed in an angle of parallel stapling (FIG. 9B). The stapler 8 then moves at the parallel stapling angle and stops moving at a predetermined position (movement corresponding to a predetermined number of pulses from the HP). The stapler 8 then waits at that position until a predetermined number of sheet members are stacked. When the predetermined number of sheet members are stacked, the stapler 8 performs a stapling process before a discharge by the ejecting claw 9*a*. Basic operation is the same in this case, too, except that there is a difference in the number of pulses between alignment on one side and that at the center.

Figure 10:
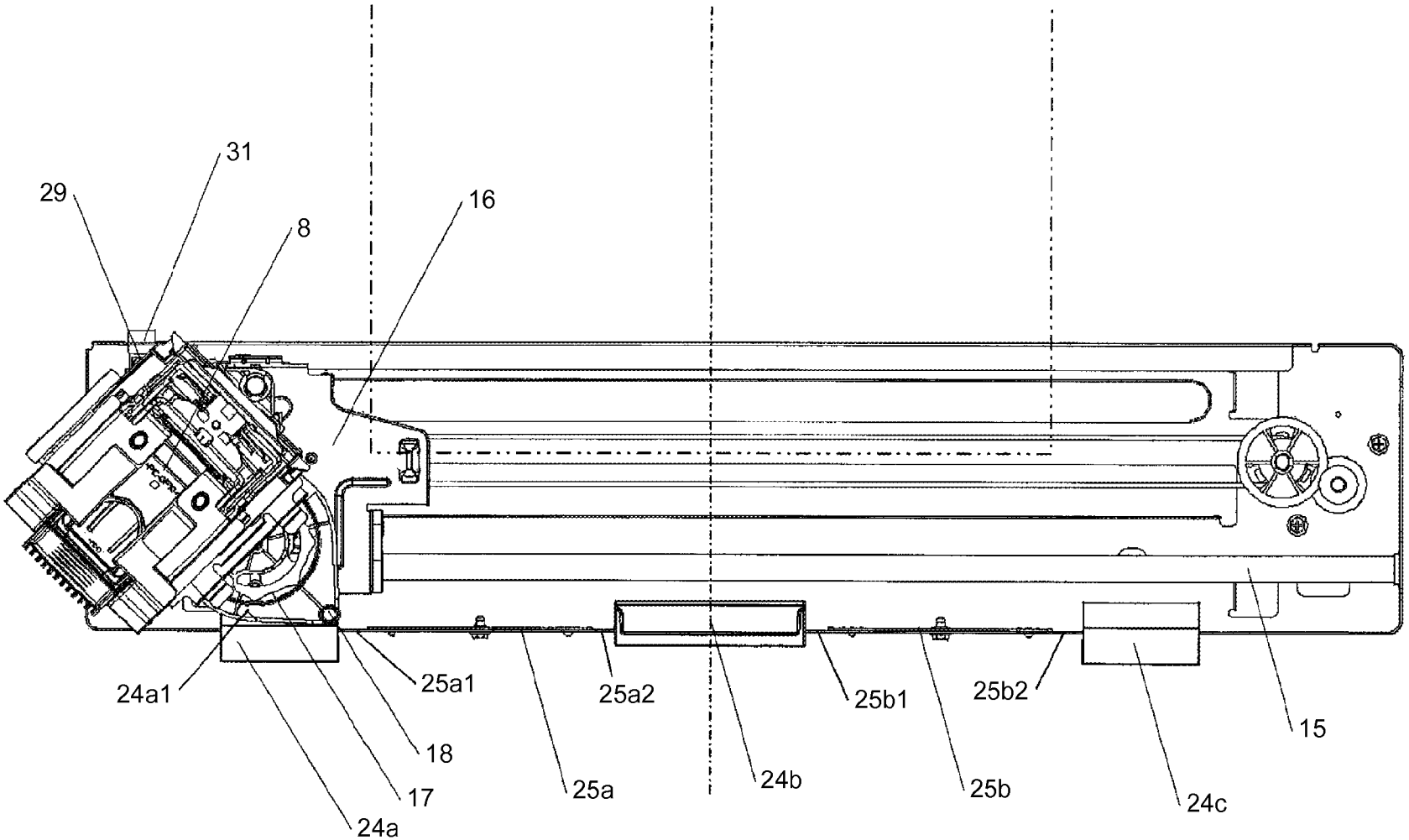
FIG. 10 is a diagram illustrating generally operation from a stapler stop to rear oblique stapling and specifically a condition in which the stapler is angled for front oblique stapling at the HP.

FIGS. 10 to 14 are diagrams illustrating operation of movement from a stapler stop to rear oblique stapling of the stapler according to the embodiment of the present invention. FIG. 10 illustrates a condition in which a home position sensor 31 detects a filler 29 of the slider 16 and the stapler 8 is angled for front oblique stapling at the HP. At this time, the abutting portion 18 of the gear 17 fits in an inside 24*a*1 of the 1st protrusion 24*a* of the abutted member 24 to ensure that the angle is not changed. The stapler 8 is at this time positioned at the front side of the apparatus, at which staples are changed.

Figure 11:
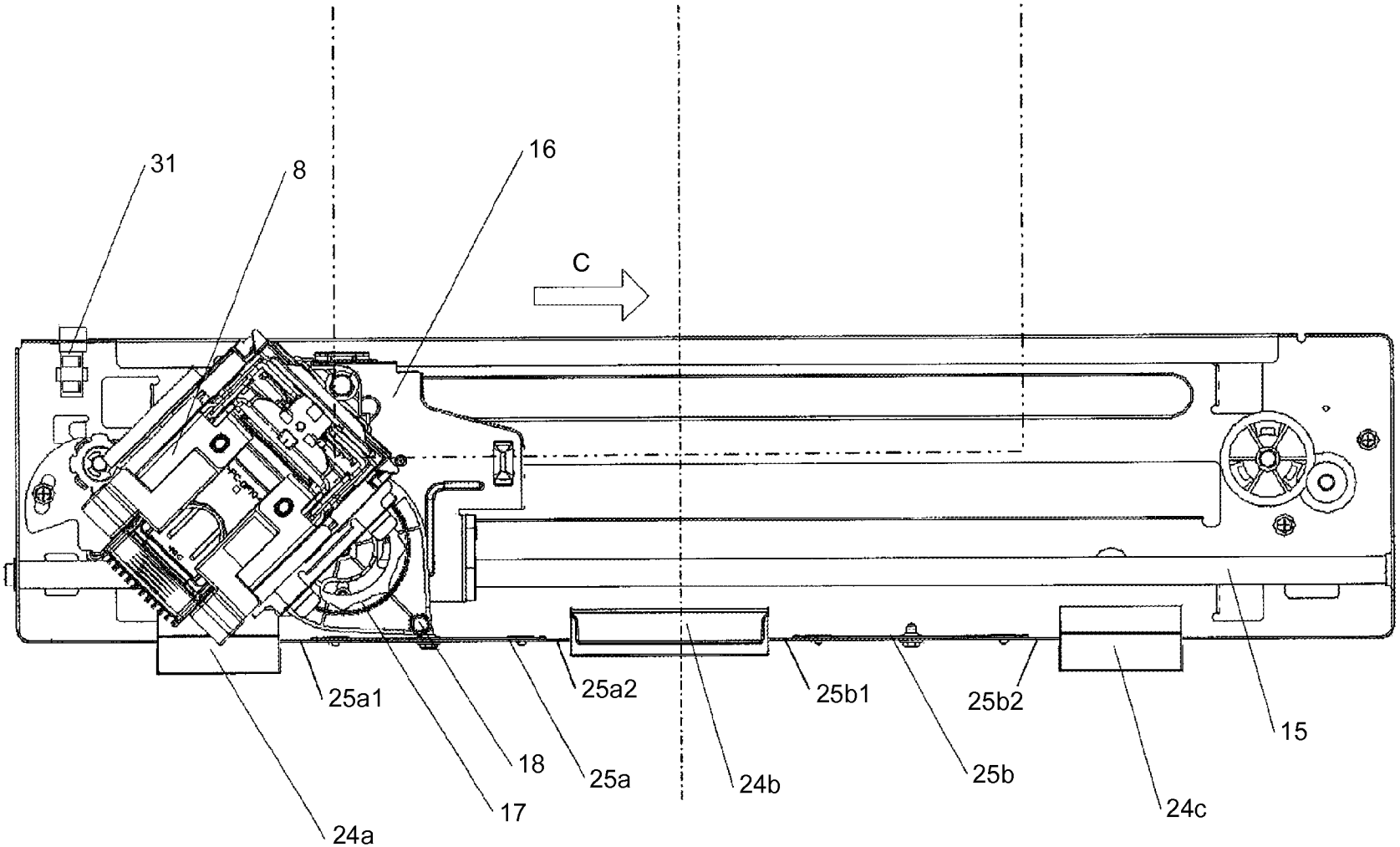
FIG. 11 is a diagram illustrating operation of movement from the condition illustrated in FIG. 10 for performing rear oblique stapling.

During stapler movement, when a rear oblique stapling mode signal is received (the mode signal is transmitted to the sheet post-processing apparatus upon a copy start), the slider 16 moves from the position illustrated in FIG. 10 in a direction of an arrow C (rightward) in FIG. 11. Then, the stapler 8 on the slider 16 moves with its angle maintained. At this time, because of a gap of 0.6 mm from the 1st plate-like member 25*a*, the abutting portion 18 moves past the 1st plate-like member 25*a* without contacting the same.

Figure 12:
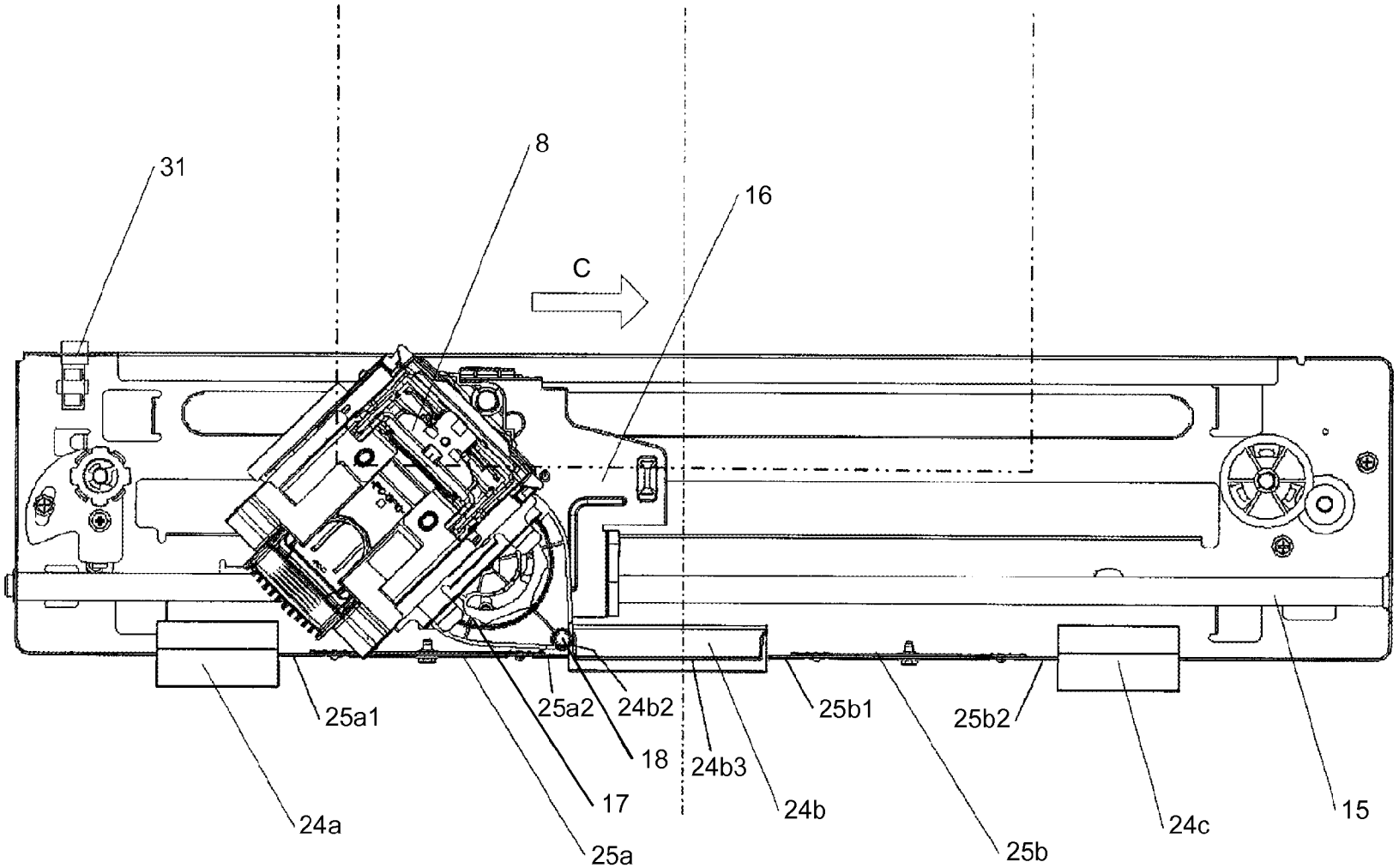
FIG. 12 is a diagram illustrating operation of shifting from the condition illustrated in FIG. 11 to parallel stapling.

Referring to FIG. 12, when the abutting portion 18 of the gear 17 abuts against a side wall 24*b*2 on the left as illustrated in FIG. 12 of the 2nd protrusion 24*b* of the abutted member 24, the slider 16 moves to the right in FIG. 12 (in the direction of the arrow C). This results in the stapler 8 starting rotating with the abutting portion 18 abutted against the side wall 24*b*2 of the 2nd protrusion 24*b*. During this time, the slider 16 keeps moving in the direction of the arrow C. As the slider 16 moves, the gear 17 and the sector gear 19 rotate and the stapler 8 that is integrated with the sector gear 19 also rotates. In addition, the 2nd gap 25*a*2 prevents the abutting portion 18 from contacting the plate-like member 25*a* when the abutting portion 18 abuts against the side wall 24*b*2 of the 2nd protrusion 24*b* and the gear 17 and the sector gear 19 rotate. The stapler 8 can thus be rotated smoothly.

The stapler 8 stops rotating when the abutting portion 18 leaves the side wall 24*b*2 of the 2nd protrusion 24*b* of the abutted member 24 onto the outside thereof. The stapler 8 is then placed at an angle of parallel stapling as illustrated in FIG. 13. The stapler 8 kept at the angle of parallel stapling moves to the parallel stapling position along an outer side surface of the plate-like member 25*b* as illustrated in FIG. 14. At this time, too, because of a gap of 0.6 mm from the plate-like member 25*a*, the abutting portion 18 moves past the plate-like member 25*a* without contacting the same and the movement is smooth.

Figure 13B:
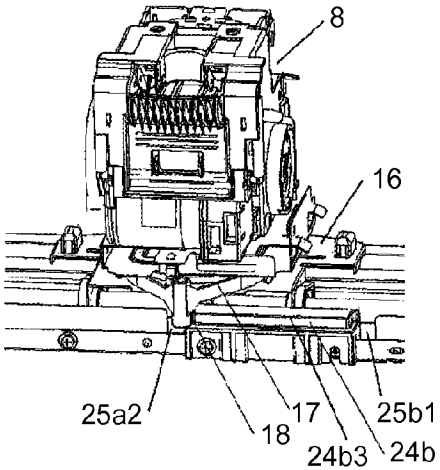
FIGS. 13A and 13B are diagrams illustrating operation of the stapler moving from the condition illustrated in FIG. 12 into a parallel stapling angular position and traveling in the parallel stapling angle.
Figure 13A:
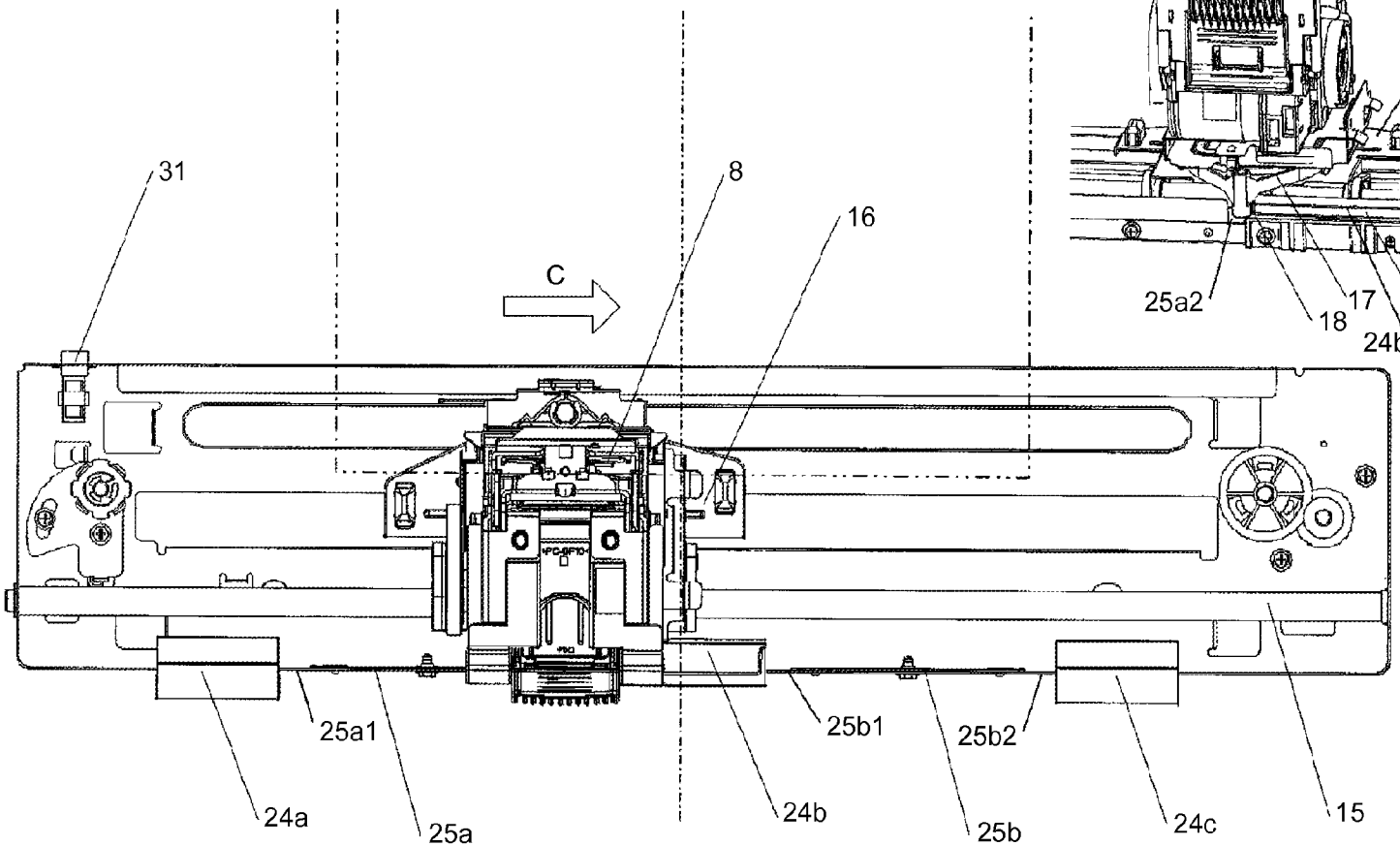
Figure 14B:
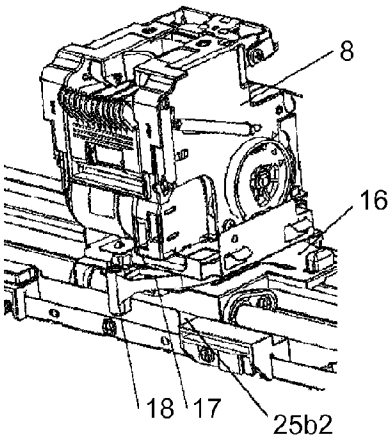
FIGS. 14A and 14B are diagrams illustrating operation of movement toward a parallel stapling position along outer side surfaces of plate-like members at the parallel stapling angle illustrated in FIGS. 13A and 13B.
Figure 14A:
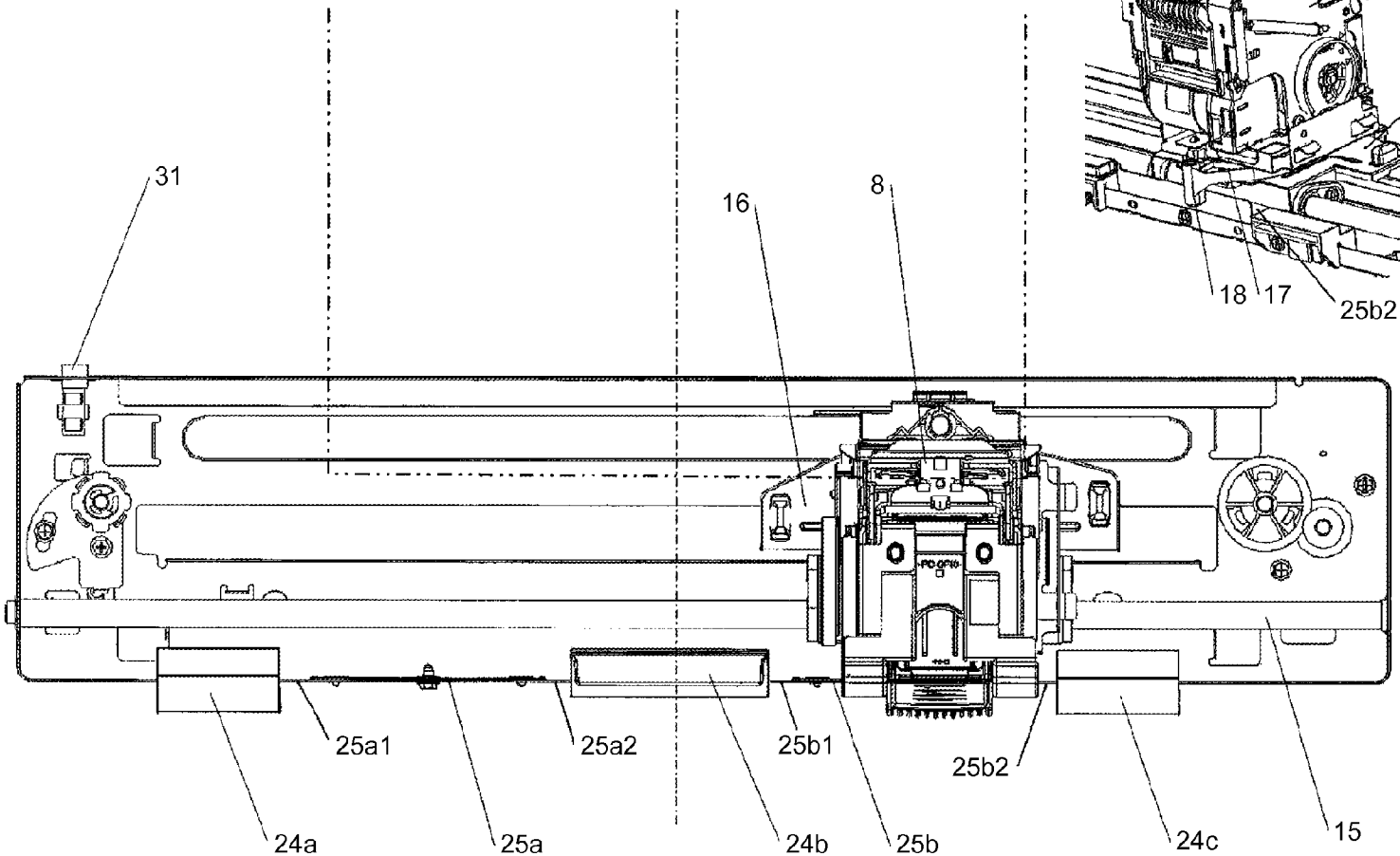

Referring to FIG. 8A, when the stapler 8 further moves in the direction of the arrow C (rightward) from the condition illustrated in FIG. 14, the abutting portion 18 abuts against the side wall 24*c*2 on the left illustrated in FIG. 8A of the 3rd protrusion 24*c* of the abutted member 24. When the stapler 8 moves further in the direction of the arrow C, the stapler 8 starts rotating clockwise as illustrated in FIG. 8B. The 4th gap 25*b*2 is provided to prevent the abutting portion 18 from contacting the plate-like member 25*b* when, through the rotation and the movement, the abutting portion 18 leaves the side wall 24*c*2 of the 3rd protrusion 24*c* toward the inside 24*c*1 of the 3rd protrusion 24*c*. Rotation of the stapler 8 is thus smooth. It is noted that FIGS. 13A and 14A are plan views, while FIGS. 13B and 14B are perspective views illustrating the stapler 8 and parts around the same.

When the abutting portion 18 leaves the 3rd protrusion 24*c*, the stapler 8 is placed in a position 45° rotated in a direction opposite to that in a HP standby position. The stapler 8 thereafter moves in the HP direction a distance corresponding to a predetermined number of pulses to a position set according to the sheet size. During this process, the sheet member is conveyed in a condition of being centrally aligned and each sheet member conveyed onto the staple tray 4T is aligned by the jogger 6. It is noted that, in FIGS. 8A, 8B through 14, the sheet discharged onto the staple tray 4T is aligned centrally. The sheet may nonetheless be aligned on one side.

Rear oblique stapling is performed when the abutting portion 18 is positioned on the inside of the 3rd protrusion 24*c* or the 2nd plate-like member 25*b*. This prevents the holding member 41 from overcoming the spring force to thereby slip off from the hole 40*c* resulting in the stapler 8 angle being changed, even when the staple tray 4T is angled at 30° as in the embodiment of the present invention.

For front oblique stapling, a stapler drive unit rotates for a predetermined number of pulses upon receipt of a front oblique stapling mode signal. At this time, the stapler 8 at the HP, while keeping the oblique position, moves a distance corresponding to the number of pulses toward the rear and stops (FIG. 11). In front oblique stapling, the stapler 8 does not need to be rotated, specifically, abutment against the protrusion of the abutted member 24 is not required, so that the movement can be kept small.

The front oblique stapling is also performed, as illustrated in FIGS. 10 and 11, when the abutting portion 18 is positioned on the inside of the 1st protrusion 24*a* or the plate-like member 25*a*. This prevents the holding member 41 from overcoming the spring force to thereby slip off from the hole 40*c* resulting in the stapler 8 angle being changed, even when the staple tray 4T is angled acutely. Basic operation is the same in this case, too, except that there is a difference in the number of pulses between alignment on one side and that at the center.

For front parallel stapling, the stapler drive unit moves the stapler, upon receipt of a front parallel stapling mode signal, until the stapler is placed into the parallel stapling angle position (number of pulses) (the condition as illustrated in FIG. 13) regardless of the sheet size. When placed in the parallel position, the stapler is moved in the HP direction a distance corresponding to the number of pulses set according to the sheet size. In alignment on one side, the number of pulses remains the same regardless of the sheet size, while in alignment at the center, a unit number of pulses applies to each sheet size. Specifically, the stapler 8 moves the greatest distance (the number of moving pulses) from the HP (at the front side) for the rear oblique stapling. No operational problem arises, therefore, as long as the stapler completes moving before the first sheet is conveyed onto the discharge tray 4 or the staple tray 4T after the receipt of the rear oblique stapling mode signal. It is noted that, in this case, too, a bundle of sheet members stapled together by the stapler 8 is discharged onto the discharge tray 4 by the ejecting claw 9*a*.

Figure 16:
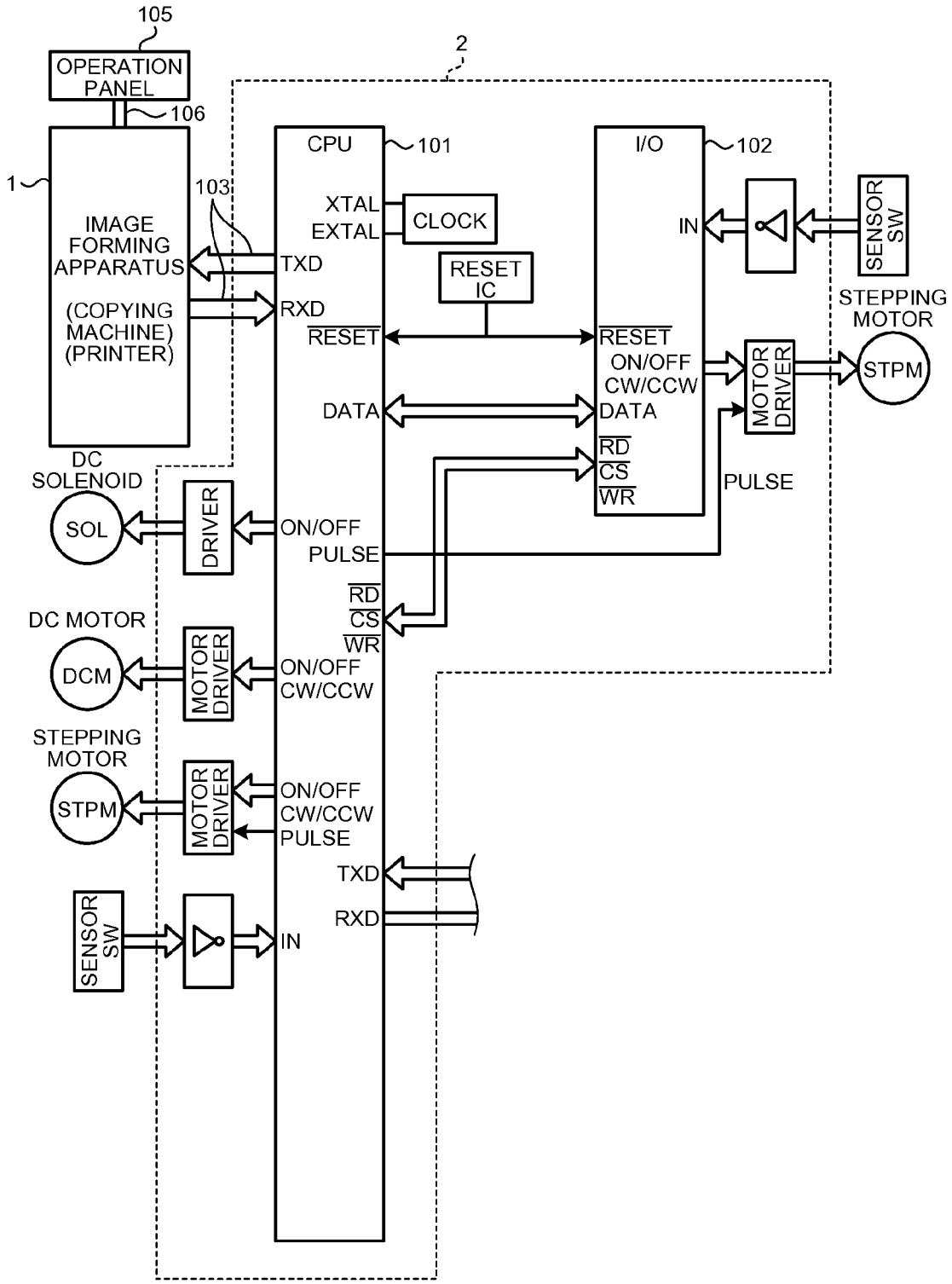
FIG. 16 is a block diagram illustrating a control configuration of the image forming system according to the embodiment of the present invention.

FIG. 16 is a block diagram illustrating a control configuration of the image forming system according to the embodiment of the present invention. The sheet post-processing apparatus 2 includes a control circuit that includes a microprocessor having a CPU 101, an I/O interface 102, and other components. The CPU 101 receives via a communication interface 103 signals from various types of switches of a CPU or an operator panel 105 and various types of sensors not illustrated of the image forming apparatus 1. The CPU 101 performs predetermined control based on the signals input thereto. In addition, the CPU 101 controls drive of a solenoid and a motor via a driver and a motor driver and acquires sensor information of the apparatus from the interface. The CPU 101 also controls the drive of the motor with the motor driver via the I/O interface 102 according to a control object or a sensor and acquires sensor information from the sensor. The above-described control is performed as follows. Specifically, the CPU 101 reads a program code stored in ROM not illustrated and loads the program code onto RAM not illustrated; the CPU 101 then performs the control based on a program defined by the program code, while using the RAM as a work area or a data buffer.

Control of the sheet post-processing apparatus 2 illustrated in FIG. 16 is performed based on instructions or information provided by a CPU of the image forming apparatus PR. A command from a user is issued from the operator panel 105 of the image forming apparatus PR and the image forming apparatus PR and the operator panel 105 are mutually connected via a communication interface 106. This enables the image forming apparatus 1 to transmit an operating signal from the operator panel 105 to the sheet post-processing apparatus 2 and the user or an operator to be notified of processing status or a function of the sheet post-processing apparatus 2 via the operator panel 105.

Figure 17:
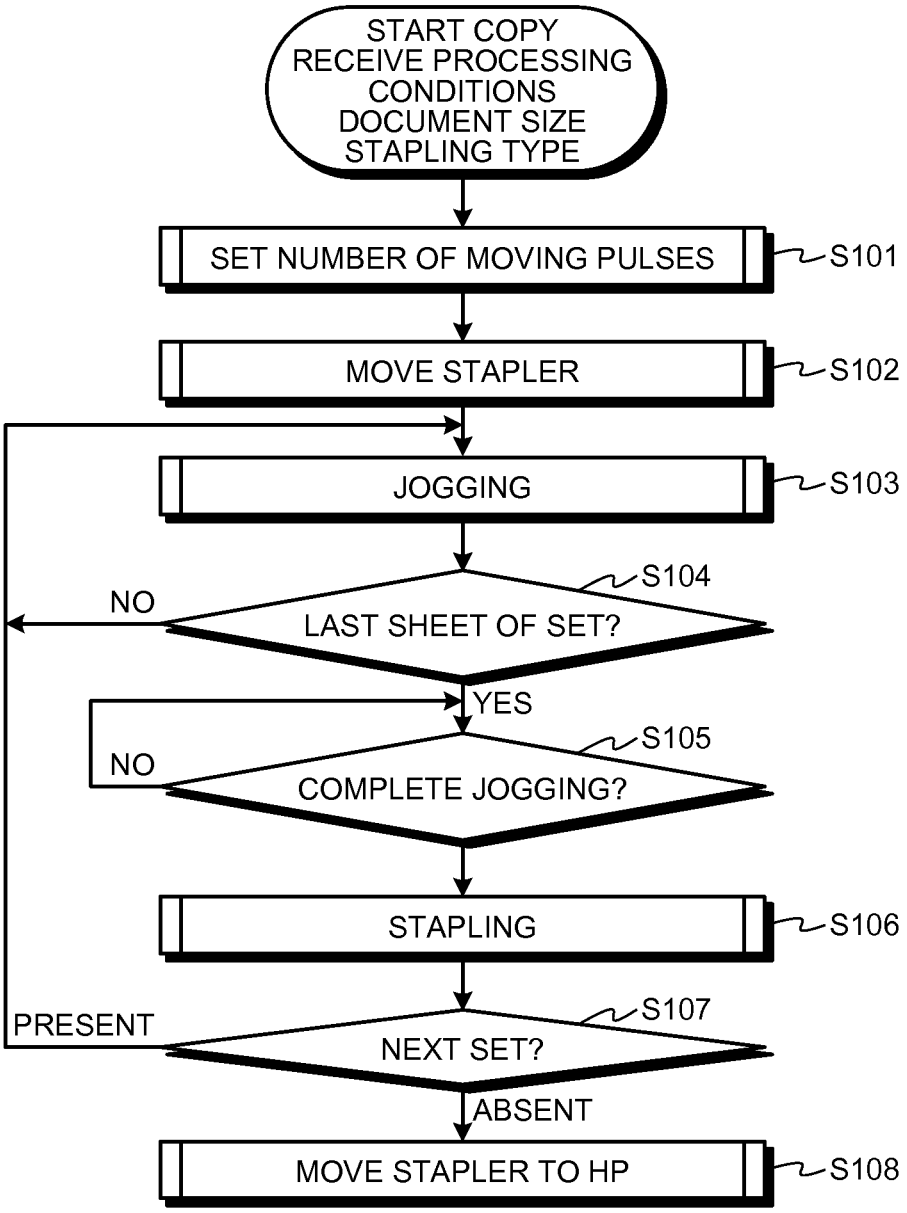
FIG. 17 is a flowchart illustrating representative processing steps of stapling.

FIG. 17 is a flowchart illustrating representative processing steps of stapling. These steps are performed by the CPU 101 of the sheet post-processing apparatus 2.

Referring to FIG. 17, when a bundle of sheet members is to be stapled, the steps illustrated in FIG. 17 are started when a copy is started on the image forming apparatus 1 and the CPU 101 of the sheet post-processing apparatus 2 receives processing conditions including a document size and a stapling type. In the processing steps, the number of moving pulses is first set based on the processing conditions received (Step S101). The stapler 8 is then moved based on the number of moving pulses before being brought into a standby state (Step S102). Each time a sheet member is discharged onto the staple tray 4T, the jogger 6 jogs to align the bundle of sheet members in the width direction (the direction orthogonal to the sheet conveying direction) (Step S103).

These steps are repeated up to a last sheet of a set (Step S104). After the last sheet of the set is jogged (Step S105), the stapler 8 performs a stapling operation (Step S106). The steps from Step 5103 to Step 5106 are repeated up to a last set (Step S107). When processing for the last set is then completed, the stapler 8 is moved back to the HP (Step S108) and the processing is completed.

An arrangement may also be made to cause the CPU of the image forming apparatus 1 to perform these steps.

The embodiment of the present invention achieves effects such as:

1) The position at which the oblique stapling is performed is restricted by the hole (slot) 40 having the V-grooves 40*a*, 40*b*, 40*c* and the holding member 41. In addition, an orientation of the gear 17, and the stapler 8 as well, is retained by the 1st and 2nd plate-like members 25*a*, 25*b* during movement of the slider 16. The parallel stapling and the oblique stapling can therefore be reliably performed without having to increase motor current.
2) The plate-like members 25*a*, 25*b* are placed at a plurality of places and there are the 1st to 4th gaps 25*a*1, 25*a*2, 25*b*1, 25*b*2 provided so as to allow the gear 17 to rotate smoothly upon contact with the abutted member 24. This enables stapling over a wide range from the center to the end portion.
3) The stapler 8 can be moved while retaining the oblique stapling position, which enables oblique stapling in various sheet sizes.

A correspondence between each element of the claims and each component of the embodiment will now be described. The stapling unit in the claims corresponds to the stapler 8 in the embodiment. The first rotating member in the claims corresponds to the sector gear 19 in the embodiment. The moving unit in the claims corresponds to the slider 16 in the embodiment. The driving unit in the claims corresponds to the motor 23 with pulleys and the timing belt 21 in the embodiment. The abutting member in the claims corresponds to the abutting portion 18 in the embodiment. The second rotating member in the claims corresponds to the gear 17 in the embodiment. The holding unit in the claims corresponds to the hole 40 and the holding member 41 in the embodiment. The abutted member in the claims corresponds to what is collectively denoted 24 (protrusions 24*a*, 24*b*, 24*c*) in the embodiment. The restricting member in the claims corresponds to the 1st and 2nd plate-like members 25*a*, 25*b* in the embodiment. The gap in the claims corresponds to the 1st to 4th gaps 25*a*1, 25*a*2, 25*b*1, 25*b*2 in the embodiment. The first holding position in the claims corresponds to the parallel stapling position in the embodiment, and the second and third holding positions in the claims correspond to the oblique stapling positions in the embodiment. The image forming system in the claim corresponds to the system including the image forming apparatus 1 and the sheet post-processing apparatus 2.

The embodiment enables reliable oblique stapling without involving increased motor current, enables stapling at a wide range from the center to end portions and enables oblique stapling of various sheet sizes.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a stapling unit that staples a sheet member;

a moving unit that linearly moves the stapling unit;

a rotating unit that rotates the stapling unit by abutment of an abutting member against an abutted member when the stapling unit is moved;

a holding unit that holds the stapling unit rotated; and a plurality of restricting members, disposed in parallel with a moving direction of the moving unit, restrict rotation of the stapling unit by abutting against the abutting member.

2. The sheet processing apparatus according to claim 1, wherein the rotating unit includes a first rotating member and a second rotating member, the stapling unit is fixed to the first rotating member, and the second rotating member includes the abutting member and rotates in conjunction with rotation of the first rotating member.

3. The sheet processing apparatus according to claim 1, wherein the abutted member comprises a plurality of abutted members and the restricting member is disposed between the abutted members, and the sheet processing apparatus further has gaps between the restricting member and the abutted members, the gaps permitting rotation of the second rotating member after the abutting member abuts against the abutted members.

4. The sheet processing apparatus according to claim 1, wherein the abutted members are disposed at three places in the moving direction, the restricting members are disposed at two places, each being disposed between two abutted members, and the stapling unit has three holding positions established according to a combination of an abutment position against the abutted members and the moving direction of the moving unit, the three holding positions including a first holding position that corresponds to parallel stapling in which the stapling unit staples the sheet member in parallel with an edge portion of the sheet member to be stapled, and second and third holding positions that correspond to oblique stapling in which the stapling unit staples the sheet member at predetermined oblique angles, the second and third holding positions being set at symmetrical angles with respect to the first holding position.

5. The sheet processing apparatus according to claim 4, wherein the abutting member moves outside the restricting members when the stapling unit moves in a condition of holding the first holding position, and moves inside the restricting members when the stapling unit moves in a condition of holding the second or third holding position.

6. An image forming system comprising:

the sheet processing apparatus according to claim 1.

7. A sheet processing apparatus comprising:

a stapling unit that staples a sheet member;

a moving unit on which the stapling unit is mounted via a rotatable first rotating member;

a driving unit that linearly moves the moving unit;

a rotatable second rotating member that is disposed in the moving unit, changes an orientation of the stapling unit in cooperation with the first rotating member, and includes an abutting member;

a holding unit that holds the orientation of the stapling unit at a plurality of positions;

an abutted member that changes the orientation of the stapling unit held by the holding unit via the second rotating member; and a plurality of restricting members disposed in parallel with a moving direction of the moving unit, the plurality of restricting members restricting the orientation of the stapling unit held by the holding unit.

8. The sheet processing apparatus according to claim 7, wherein the abutted member comprises a plurality of abutted members and the restricting member is disposed between the abutted members, and the sheet processing apparatus further has gaps between the restricting member and the abutted members, the gaps permitting rotation of the second rotating member after the abutting member abuts against the abutted members.

9. The sheet processing apparatus according to claim 7, wherein the abutted members are disposed at three places in the moving direction, the restricting members are disposed at two places, each being disposed between two abutted members, and the stapling unit has three holding positions established according to a combination of an abutment position against the abutted members and the moving direction of the moving unit, the three holding positions including a first holding position that corresponds to parallel stapling in which the stapling unit staples the sheet member in parallel with an edge portion of the sheet member to be stapled, and second and third holding positions that correspond to oblique stapling in which the stapling unit staples the sheet member at predetermined oblique angles, the second and third holding positions being set at symmetrical angles with respect to the first holding position.

10. The sheet processing apparatus according to claim 9, wherein the abutting member moves outside the restricting members when the stapling unit moves in a condition of holding the first holding position, and moves inside the restricting members when the stapling unit moves in a condition of holding the second or third holding position.

11. An image forming system comprising:

the sheet processing apparatus according to claim 7.

* * * * *